US010059350B2

(12) United States Patent
Drexler et al.

(10) Patent No.: US 10,059,350 B2
(45) Date of Patent: Aug. 28, 2018

(54) RAIL VEHICLE, IN PARTICULAR A LOCOMOTIVE

(71) Applicant: SIEMENS AKTIENGESELLSCHAFT, Munich (DE)

(72) Inventors: Stephan Drexler, Sauerlach (DE); Manuel Kroiss, Ebersbach (DE); Rolf Steude, Munich (DE); Robert Thiess, Unterschleissheim (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/117,827

(22) PCT Filed: Feb. 10, 2014

(86) PCT No.: PCT/EP2014/052516
§ 371 (c)(1),
(2) Date: Aug. 10, 2016

(87) PCT Pub. No.: WO2015/117678
PCT Pub. Date: Aug. 13, 2015

(65) Prior Publication Data

US 2016/0368511 A1 Dec. 22, 2016

(51) Int. Cl.
*B61F 5/02* (2006.01)
*B61F 5/16* (2006.01)

(52) U.S. Cl.
CPC . *B61F 5/16* (2013.01); *B61F 5/02* (2013.01)

(58) Field of Classification Search
CPC ..... B61F 5/02; B61F 5/16
See application file for complete search history.

(56) References Cited

U.S. PATENT DOCUMENTS 3,841,232 A * 10/1974 Hess ..... B61F 1/06 105/171
4,841,874 A * 6/1989 Weigel ..... B61F 5/20 105/199.4
2016/0368511 A1* 12/2016 Drexler ..... B61F 5/02

FOREIGN PATENT DOCUMENTS

CN 201494458 U 6/2010
CN 201636164 U 11/2010
CN 102019940 A 4/2011
CN 102079317 A 6/2011
(Continued)

*Primary Examiner* — Jason C Smith
(74) *Attorney, Agent, or Firm* — Laurence Greenberg; Werner Stemer; Ralph Locher

(57) ABSTRACT

A rail vehicle, such as a locomotive, has at least one undercarriage with one or more wheel sets and an undercarriage frame. A vehicle body, resiliently supported on the undercarriage, has a vertical pivot pin passing through the undercarriage frame for traction linking the vehicle body. A limiting stop is connected to the pivot pin for limiting the vertical motion of the vehicle body relative to the undercarriage frame. The pivot pin has a horizontal through-hole in a downwardly protruding pin segment for supporting the limiting stop. Contact protrusions of the limiting stop protrude from the through-hole on both sides of the pivot pin. In the event of maximum vertical motion, the limiting stop contacts the undercarriage frame from below by way of the contact protrusions. The entrainment of the undercarriage is thus effected with great safety when the rail vehicle is lifted.

7 Claims, 2 Drawing Sheets

(56) References Cited

FOREIGN PATENT DOCUMENTS

| | | | | | |
|---|---|---|---|---|---|
| CN | 202251312 | U | | 5/2012 | |
| CN | 202402433 | U | | 8/2012 | |
| DE | 2120874 | B2 | | 11/1972 | |
| EP | 0918007 | A1 | | 5/1999 | |
| EP | 2457799 | A1 | * | 5/2012 | ..... B25J 15/04 |
| EP | 2457799 | A1 | | 5/2012 | |
| FR | 2131368 | A5 | | 11/1972 | |
| FR | 2609676 | A1 | * | 7/1988 | ..... B61F 5/20 |
| FR | 2609676 | A1 | | 7/1988 | |
| RU | 2065823 | C1 | | 8/1996 | |

* cited by examiner

RAIL VEHICLE, IN PARTICULAR A LOCOMOTIVE

BACKGROUND OF THE INVENTION

Field of the Invention

The invention relates to a rail vehicle, in particular a locomotive, according to the pre characterizing clause of claim 1.

A generic rail vehicle, in particular a locomotive, comprises at least one undercarriage, which has one or more wheel sets and an undercarriage frame resiliently supported thereon. It further comprises a vehicle body which is resiliently supported on the at least one undercarriage, and on which at least one vertical pivot pin is arranged protruding downward. The pivot pin passes through the undercarriage frame for the traction linking of the vehicle body. The at least one undercarriage can be rotated about the pivot pin in relation to the vehicle body. The rail vehicle further comprises a limiting stop connected to the pivot pin for limiting the vertical motion of the vehicle body in relation to the undercarriage frame in a form-fit manner.

On the one hand the limiting stop is deployed when the rail vehicle has to be lifted for transportation purposes, for rerailing or for towing, so that when the vehicle body is lifted the undercarriage is lifted with it too. On the other hand the limiting stop defines the maximum permitted spring excursion of the secondary suspension, via which the vehicle body is sprung on the undercarriage.

From laying-out document DE 21 20 874 B2 a bogie for a locomotive is known, on the bogie frame of which a tunnel support bearing the locomotive structure is supported via bolster springs. When the locomotive is lifted a lifting device engages in retaining elements on the tunnel support. The bogie is lifted along with the wheel sets located thereon by way of a carrier plate on the pivot pin.

It has long been known for such carrier plates to be fastened to the pivot pin by means of screw connections, in particular with vertical screw axes.

BRIEF SUMMARY OF THE INVENTION

The object of the invention is now to provide a rail vehicle of the type cited in the introduction which when the rail vehicle is lifted enables the at least one undercarriage to be lifted too with greater safety.

The object is inventively achieved by a generic rail vehicle, in which the pivot pin has a horizontal through-hole in a pin segment projecting downward from the undercarriage frame, in which through-hole the limiting stop is mounted and from which contact protrusions of the limiting stop protrude out on both sides of the pivot pin, the limiting stop contacting the undercarriage frame from below with said contact protrusions in the event of maximum vertical motion. The limiting stop can be designed as a bolt element with for example a circular cross-section which penetrates the through-hole of the pivot pin, without any gap, transversely to a vehicle longitudinal axis. As a result a form-fit connection between limiting stop and pivot pin is achieved, which blocks the limiting stop from moving transversely to the axis of the through-hole. By avoiding force-fit connecting portions, as are present in the case of screw connections, it is ensured that when the rail vehicle is lifted above the limiting stop the undercarriage is safely lifted too. When the vehicle body is lifted the undercarriage initially stays where it is because of its mass, with relaxation of the secondary suspension, until the contact protrusions of the limiting stop protruding out of the pivot pin contact the undercarriage from below, for example the lower boom of a cross-support of the undercarriage frame, and lift this too in the event that the vehicle body is lifted further.

In an advantageous embodiment of the inventive rail vehicle each contact protrusion has an upward-facing, level contact surface, with which the limiting stop abuts on the undercarriage frame from below in the event of maximum vertical motion. Because the limiting stop abuts flat on the undercarriage the weight force of the undercarriage to be transferred is distributed onto the contact surfaces during lifting, which means the pressure acting locally on the limiting stop and undercarriage frame is reduced. The contact surfaces can be produced on the contact protrusions of a bolt-shaped limiting stop by milling. Because of the flat contact a secure abutment of the limiting stop on the undercarriage frame is defined, which prevents damage to the contact partners.

In a preferred embodiment of the inventive rail vehicle the limiting stop is secured by securing means against changes of position in the through-hole. This means for example that any displacement or distortion of the limiting stop in the through-hole is prevented. Thus the contact protrusions of the limiting stop are prevented from protruding unequally far out of the pivot pin and thus from being unequally stressed. In particular the limiting stop is prevented from falling out of the through-hole as a result of being displaced. Further, any alteration in the upwardly oriented position of the contact surfaces as a result of the limiting stop being distorted in the through-hole is prevented.

Preferably securing means are formed by at least one collar on the limiting stop and by a securing element which is connected to the pivot pin and which to secure the limiting stop against displacement engages in a form-fit manner on the collar. The collar on a bolt-shaped limiting stop can for example be formed as a radial step of a turned shoulder or of a milled-off surface. The securing element can be designed as a sheet-metal part detachably fastened to the pivot pin, said sheet-metal part engaging behind the collar of the limiting stop such that the limiting stop is blocked from moving.

Further preferably the securing means are formed by a keep out area integrally formed on the periphery of the limiting stop and by a securing element connected to the pivot pin, said securing element abutting on the keep out area to secure the limiting stop against distortion. The keep out area on the periphery of a bolt-shaped limiting stop can be formed for example by a milled-in groove or a milled-off open area. The securing element can be designed as a sheet-metal part which is detachably connected to the pivot pin and whose longitudinal edge abuts linearly on the keep out area, such that any distortion of the limiting stop is blocked.

Advantageously the securing means against displacement and distortion can be formed by a common securing element. The securing elements can advantageously be provided on both sides of the pivot pin.

In an advantageous embodiment of the inventive rail vehicle at least one of the contact protrusions is designed to taper toward its outer end. The taper can be formed by oblique milling-off on one or both contact protrusions of the limiting stop, preferably on the side of the limiting stop opposite the contact surfaces. Thanks to the taper at the outer end of the contact protrusion an assembly aid for inserting the limiting stop into the through-hole of the pivot pin is achieved. In addition the material abrasion reduces the mass of the limiting bolt, which facilitates the handling thereof and reduces the overall weight of the vehicle.

BRIEF DESCRIPTION OF THE SEVERAL VIEWS OF THE DRAWING

Further properties and advantages of the inventive rail vehicle emerge from the following description of an exemplary embodiment on the basis of the drawings, in which schematically

DESCRIPTION OF THE INVENTION

Figure 1:
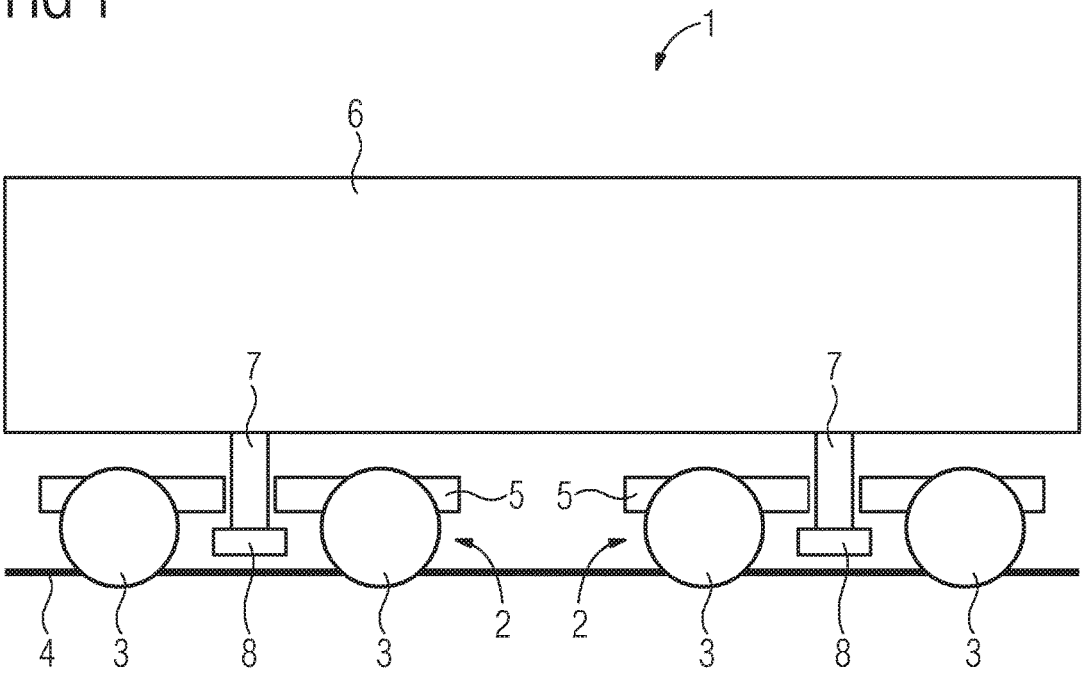
FIG. 1 shows an inventive rail vehicle standing on a track.
Figure 2:
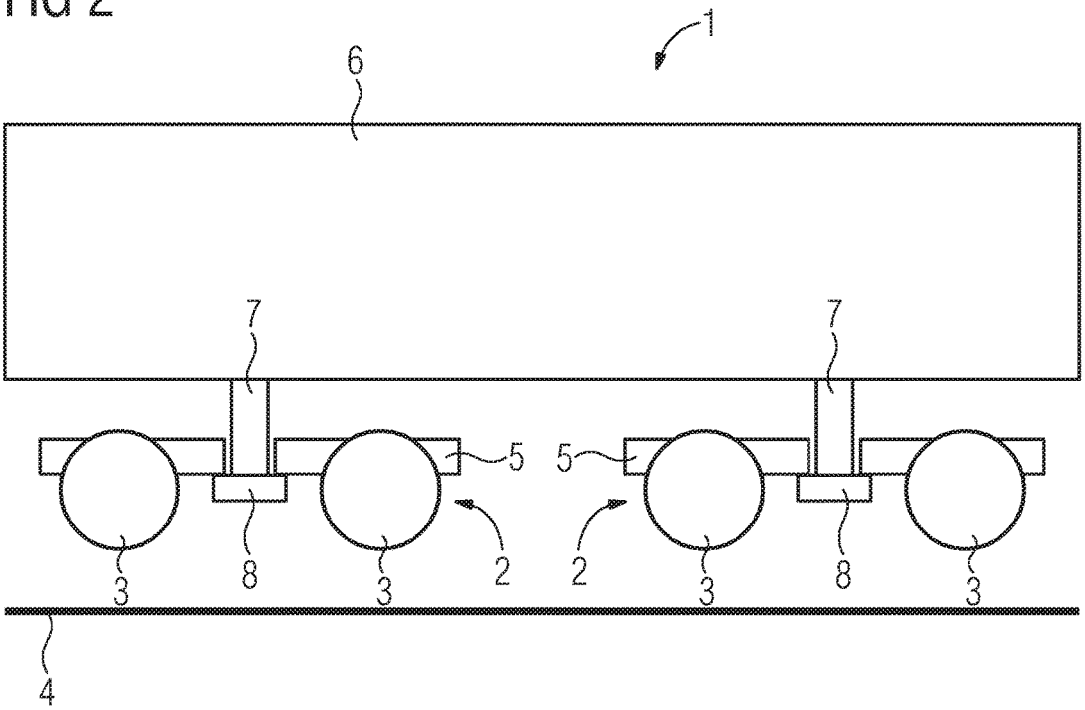
FIG. 2 shows the rail vehicle according to FIG. 1 lifted off the track and FIG. 3 shows a perspective view from below of the undercarriage of the inventive rail vehicle in the region of the pivot pin.

A rail vehicle 1, for example a locomotive, comprises two undercarriages 2, each with two wheel sets 3, by way of which the undercarriages 2 according to FIG. 1 stand on a track 4. Each undercarriage 2 has an undercarriage frame 5 which is resiliently supported on the wheel sets 3. The rail vehicle 1 further comprises a vehicle body 6 resiliently supported on the undercarriages 2. From the vehicle body 6 a vertical pivot pin 7 protrudes downward for each undercarriage 2 and for the traction linking of the vehicle body 6 passes through the undercarriage frame 5, and about which an undercarriage 2 can rotate in relation to the vehicle body 6. The rail vehicle 1 additionally comprises limiting stops 8 connected to the pivot pin 7 to limit the vertical motion of the vehicle body 6 in relation to the undercarriage frame 5 in a form-fit manner. If the rail vehicle 1 is lifted off the track 4 by engagement on the vehicle body 6 according to FIG. 2, the vehicle body 6 moves vertically away from the undercarriages 2, until the limiting stops 8 achieve a form-fit with the undercarriage frame 5 and from then on lift the undercarriages 2 too.

Figure 3:
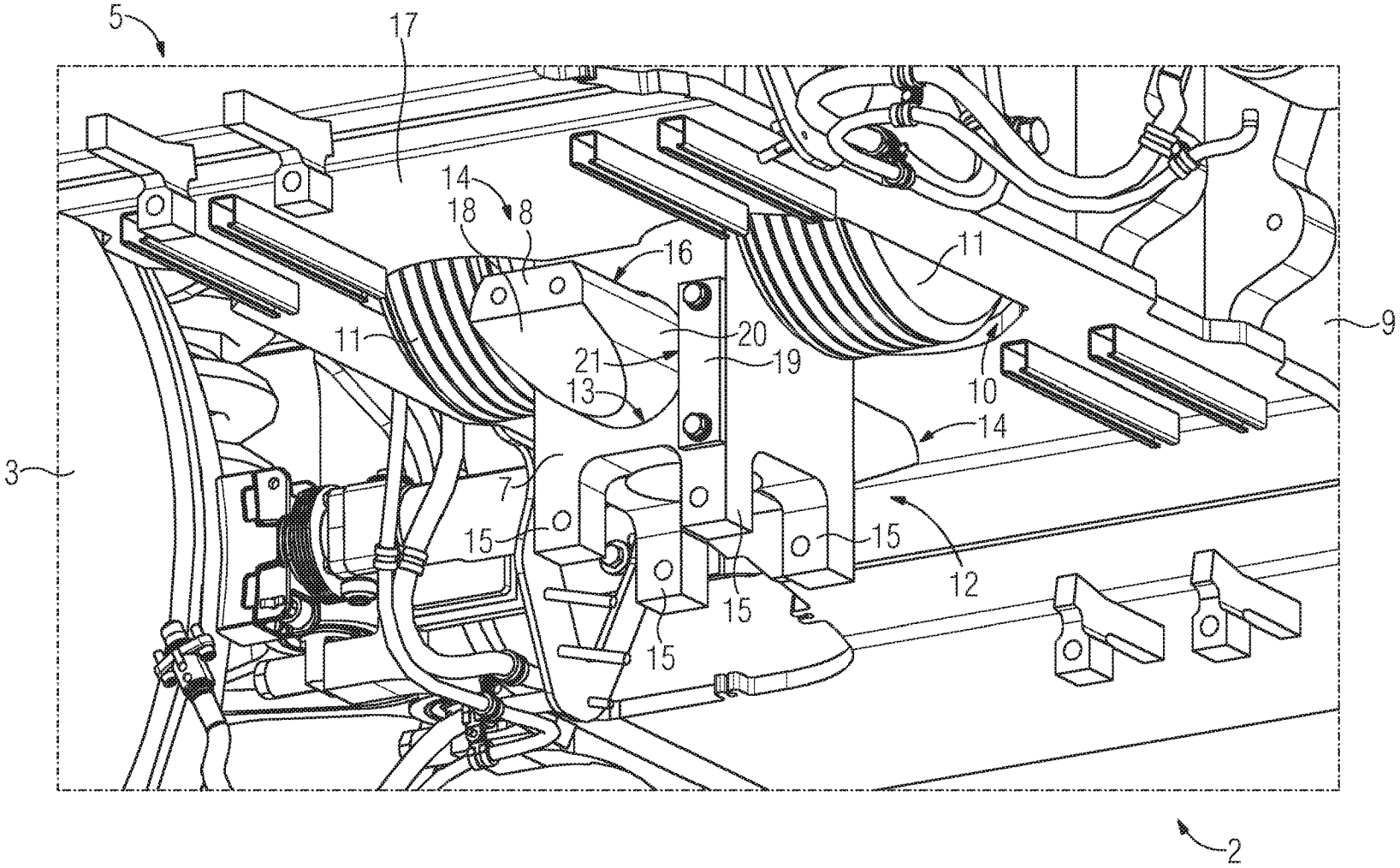

According to FIG. 3 the pivot pin 7 passes through a cross-support 9 of the undercarriage frame 5. The pivot pin 7 protrudes through a pin opening 10 in the cross-support 9 and at least in the region of the pin opening 10 has a rectangular external cross-section. For the damped traction linking of the vehicle body 6 when the undercarriages 2 accelerate or decelerate, buffer elements 11 are arranged in the pin opening 10 on the cross-support 9 in the direction of travel in front of and behind the pivot pin 7. The pivot pin 7 has a pin segment 12 protruding downward from the cross-support 9 of the undercarriage frame 5, with fastening elements 15 for transverse dampers (not shown) sticking out from the free end of the pin segment 12 in the shape of a crown. Additionally the pin segment 12 has a horizontal through-hole 13 extending transversely to the direction of travel. The limiting stop 8 is bolt-shaped and embodied with a round cross-section and is mounted preferably without any play and centered in the through-hole 13. As a result contact protrusions 14 of the limiting stop 8 protrude on both sides of the pivot pin 7, the limiting stop 8 contacting the cross-support 9 from below with said contact protrusions 14 in the event of maximum vertical motion. So that this contact takes place in a defined manner and without damage, level contact surfaces 16 are integrally formed by milling off on the upper sides of the contact protrusions 14, and in the event of contact abut on a lower boom 17 of the cross-support 9 to the side of the pin opening 10. The two contact protrusions 14 have chamfers 18 on their undersides and are therefore designed to taper toward their outer ends. This means the limiting stop 8 can be inserted more easily into the through-hole 13 when it is assembled. Additionally weight can be saved as a result. The inserted limiting stop 8 is then secured by securing means against changes of position in the through-hole 13. The securing means comprise a securing element 19 which is connected to the pivot pin 7, is designed as a rectangular sheet-metal part and is attached edgewise to the pivot pin 7 by means of two screws such that it covers the through-hole 13 in the shape of a segment of a circle. The securing means further comprise a keep out area 20 which is milled off on the contact protrusion 14 of the limiting stop 8, is designed to be level and is oriented vertically. At the transition from the contact protrusion 14 provided with the keep out area 20 to the bolt-shaped central segment of the limiting stop 8 with a circular cross-section a collar 21 is designed as part of the securing means. The securing element 19 engages in a form-fit manner on the collar 21, so that any displacement of the limiting stop 8 in the through-hole 13—at least in a direction of displacement—is blocked. Additionally the securing element 19 abuts linearly on the keep out area 19, so that any distortion of the limiting stop 8 in the through-hole 13 is blocked. Preferably the securing means are arranged point-symmetrically on both sides of the pivot pin 7.

The invention claimed is:

1. A rail vehicle, comprising:

at least one undercarriage having one or more wheel sets and an undercarriage frame resiliently supported on said one or more wheel sets;

a vehicle body resiliently supported on said at least one undercarriage;

a vertical pivot pin passing through said undercarriage frame, said pivot pin traction linking said vehicle body and said undercarriage and allowing said undercarriage to rotate relative to said vehicle body;

said pivot pin having a pin segment projecting downward from said undercarriage frame and a horizontal through-hole formed through said pin segment;

a limiting stop connected to said pivot pin for limiting a vertical movement of said vehicle body relative to said undercarriage frame, said limiting stop being mounted in said through-hole and having contact protrusions projecting on both sides of said pivot pin, said contact protrusions of said limiting stop contacting said undercarriage frame from below in the event of a maximum vertical movement of said vehicle body relative to said undercarriage frame.

2. The rail vehicle according to claim 1 configured as a locomotive.

3. The rail vehicle according to claim 1, wherein each said contact protrusion has an upward-facing, level contact surface, with which said limiting stop abuts against said undercarriage frame from below in the event of the maximum vertical movement.

4. The rail vehicle according to claim 1, which comprises securing devices disposed to secure said limiting stop against changes of a position thereof in said through-hole.

5. The rail vehicle according to claim 4, wherein said securing devices comprise at least one collar on said limiting stop and a securing element connected to said pivot pin, said securing element engaging in a positive form-fit on said collar to secure said limiting stop against displacement.

6. The rail vehicle according to claim 4, wherein said securing devices comprise at least one arresting surface integrally formed on a periphery of said limiting stop and a securing element connected to said pivot pin and abutting said arresting surface to secure said limiting stop against rotation.

7. The rail vehicle according to claim 1, wherein at least one of said contact protrusions is formed with a taper toward an outer end thereof.

* * * * *